US009429015B2

(12) United States Patent
Fader et al.

(10) Patent No.: US 9,429,015 B2
(45) Date of Patent: Aug. 30, 2016

(54) CUTTING TIP AND CUTTING BIT HAVING INCREASED STRENGTH AND PENETRATION CAPABILITY

(75) Inventors: Joseph Fader, Graz (AT); Alfred Lammer, Zeltweg (AT)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 135 days.

(21) Appl. No.: 14/128,019

(22) PCT Filed: Jun. 21, 2012

(86) PCT No.: PCT/EP2012/061902

§ 371 (c)(1),
(2), (4) Date: Dec. 20, 2013

(87) PCT Pub. No.: WO2013/000798

PCT Pub. Date: Jan. 3, 2013

(65) Prior Publication Data

US 2014/0117740 A1 May 1, 2014

(30) Foreign Application Priority Data

Jun. 28, 2011 (EP) ..... 11171611

(51) Int. Cl.
*E21C 35/183* (2006.01)
*E21C 35/18* (2006.01)

(52) U.S. Cl.
CPC ..... *E21C 35/18* (2013.01); *E21C 35/183* (2013.01)

(58) Field of Classification Search
CPC ..... E21C 2035/1803; E21C 2035/1806; E21C 2035/1809; E21C 2035/1816; E21C 35/183
USPC ..... 299/100, 101, 111, 112 T, 113, 299/102–107, 110; 175/420.1, 426
See application file for complete search history.

(56) References Cited

U.S. PATENT DOCUMENTS 4,940,288 A * 7/1990 Stiffler ..... E21C 35/183 299/113
5,219,209 A * 6/1993 Prizzi ..... E21C 35/183 299/111
6,375,272 B1 * 4/2002 Ojanen ..... E21C 35/183 299/110
2006/0125306 A1 6/2006 Sollami
2008/0036269 A1 2/2008 Hall

* cited by examiner

*Primary Examiner* — Sunil Singh
(74) *Attorney, Agent, or Firm* — Corinne R. Gorski

(57) ABSTRACT

A profile of a cutting tip includes a convex portion extending from a cutting end to an inflection point located at an axial and radial distance from the cutting end. A concave portion extends from the inflection point to a point at a greater radial and axial distance from the cutting end. The profiles of the generally concave portion and the generally convex portion have a first linear portion defined by a portion of a first line extending from a first point at a first radial position to a second point at a second radial position and axially spaced from the first point. A second linear portion is defined by a portion of a second line extending from a third point to a fourth point at the second radial position and at an axial distance from the second point corresponding to about half a length of the first line.

17 Claims, 8 Drawing Sheets

CUTTING TIP AND CUTTING BIT HAVING INCREASED STRENGTH AND PENETRATION CAPABILITY

RELATED APPLICATION DATA

This application is a §371 National Stage Application of PCT International Application No. PCT/EP2012/061902 filed Jun. 21, 2012 claiming priority of EP Application No. 11171611.4 filed on Jun. 28, 2011.

TECHNICAL FIELD

The present disclosure relates to cutting tips and cutting bits for use in a heavy-duty mining or drilling apparatus or in a road milling apparatus.

The disclosure particularly relates to so-called "pick type tips".

BACKGROUND

In e.g. mining, drilling or road milling applications, a drive body, which may have the form of e.g. a drum or a drill head, is provided with a number of replaceable cutting bits, which present a very hard cutting end. Non-limiting examples of such drive bodies are shown in FIGS. 1 and 14-20 of US2008/258536A1.

The bit shown in US2008/258536A1 comprises a head portion, which may be approximately conical and taper towards a cutting end; and a shank, which is insertable into a bit holder. The bit is a wear part, and hence it is desirable to be able to rapidly replace worn bits, and also to produce such bits at as low cost as possible.

However, in order to minimize machine downtime, it is also desirable to have to replace the cutting bits as seldom as possible. Hence, it is desirable to provide cutting tips which are as strong as possible.

Various cutting tip designs are shown in U.S. Pat. No. 6,375,272 B1, DE 295 04 676 U1, U.S. Pat. No. 6,986,552 B1, WO01/73252 A2, EP 0 757 157 A1, DE 28 46 744 A1, U.S. Pat. No. 5,219,209, WO94/13932 A1, U.S. Pat. Nos. 4,911,504 and 4,981,328.

There is a continuing need for cutting tips having further improved strength and/or penetration capability.

SUMMARY

It is a general object of the present disclosure to provide a cutting tip having improved strength and/or penetration capability.

According to a first aspect, there is provided a cutting tip, presenting a generally conical body, which is substantially rotationally symmetric about a center axis of the cutting tip and presenting a profile in a longitudinal section through the center axis. The profile comprising a generally convex portion, which extends from a cutting end situated on the center axis, to an inflection point, which is located at an axial and radial distance from the cutting end, towards a base portion of the body, and a generally concave portion, which extends from the inflection point to a point which is located at a greater radial and axial distance from the cutting end, and axially closer to the base portion. The profile of at least one of the generally concave portion and the generally convex portion comprises a first linear portion, defined by a portion of a first line, which first line extends from a first point at a first radial position, at an angle of about 45 degrees relative to the center axis, to a second point at a second radial position and axially spaced from the first point, and a second linear portion, defined by a portion of a second line, which second line extends from a third point, forming an approximate middle point of the first line, to a fourth point at the second radial position and at an axial distance from the second point corresponding to about half a length of the first line.

By "about" and "approximately" is meant +/−10%, preferably +/−5% and most preferably +/−2%.

It is understood that each "linear portion" of the profile will correspond to a frusto-conical portion of the cutting tip body.

The invention is based on the "tree design" concept, which, as such, is known from e.g. Mattheck, C. et al.: "A Most Simple Graphic Way to Reduce Notch Stresses by Growth", Forschungszentrum Karlsruhe GmbH, Institute for Materials Research II, September 2005, herein incorporated by reference. The idea behind this design concept is to provide material only where it is needed, thus providing an optimal tradeoff between strength and material consumption/weight.

A cutting tip according to the present disclosure provides a slight increase in strength, while providing increased penetration capability.

With the design concept disclosed herein, it is possible to provide a smaller radius at the cutting end than with conventional designs, with retained strength, thus increasing the cutting tip's penetration.

In the cutting tip, said at least one of the generally concave portion and the generally convex portion may further comprise a third linear portion, defined by a portion of a third line, which third line extends from a fifth point, forming an approximate middle point of the second line, to a sixth point at the second radial position and at an axial distance from the fourth point corresponding to about half a length of the second line.

The convex portion may present at least two linear sections presenting a respective angle relative to the center axis and the concave portion may present at least two linear sections presenting a respective angle relative to the center axis. The angles of all successive linear sections of the convex portion may increase towards the cutting end, and the angles of all successive linear sections of the concave portion may decrease towards the cutting end.

All angles of the linear sections of at least one of the convex portion and the concave portion may be greater than about 5 degrees.

In the concave portion, the first radial position may be at an outer radius and the second radial position may be at an inner radius, which is smaller than the outer radius.

The inner radius may be about 20-30% of the larger outer radius, preferably about 25%.

In the convex portion, the first radial position may be substantially at the center axis and the second radial position is at a greater inner radius.

A linear section forming part of the convex portion may present substantially the same angle as a linear section forming part of the concave portion.

Two linear sections forming part of the convex portion may present substantially the same angles as respective linear sections forming part of the concave portion.

A transition between two adjacent linear portions presents approximately a radius.

The cutting tip may further present a radius forming the cutting end.

The concave portion may present two linear portions, presenting, as seen axially from the base portion towards the cutting end, angles of about 45 degrees and about 21 degrees, respectively.

The concave portion may present a third linear portion, presenting an angle of about 10 degrees.

The concave portion may present three linear portions, presenting axial lengths of about 23%, about 29% and about 33%, respectively, of an overall length of the concave portion.

The convex portion may present two linear portions, presenting as seen axially from the base portion towards the cutting end, angles of about 21 degrees and about 45 degrees, respectively.

The convex portion may present two linear portions, presenting axial lengths of about 40% and about 30%, respectively, of an overall length of the convex portion.

DESCRIPTION OF EMBODIMENTS

A cutting bit usually includes a tool pick and a cutting tip. The tool pick would have a head and a shank. The head would have a front surface, a side surface extending axially rearwardly from the front surface toward a shoulder. The side surface can be of various forms from being oriented substantially perpendicular to a center axis of the cutting bit to being oriented at an angle to the center axis and combinations thereof. The form of the side surface can be planar, concave, convex, or combinations thereof. A cutting tip would be attached to the head of the tool pick. The cutting tip is made from a hard material. A suitable hard material for the cutting tip is sintered cemented carbide or a diamond composite material including diamond crystals bonded together by a silicon carbide matrix. An exemplary composition of the cemented carbide includes 6-12 weight percent cobalt with the balance tungsten.

Figure 1:
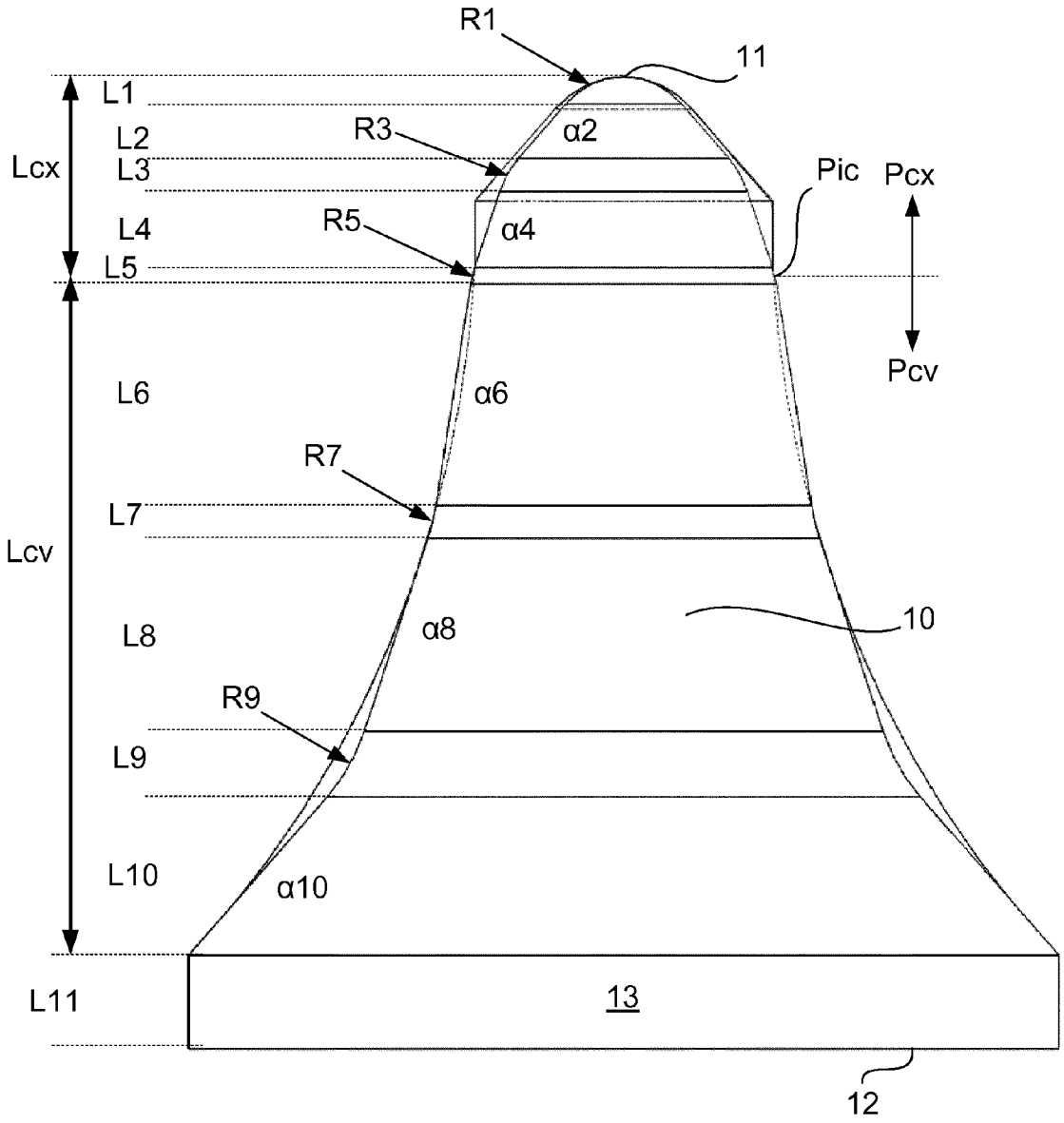
FIG. 1 is a schematic sectional view illustrating the cutting tip according to the present disclosure in relation to a traditionally designed cutting tip.

FIG. 1 illustrates a cutting tip which is designed according to the tree design principle. The cutting tip 1 presents a generally conical body 10, which is rotationally symmetrical, with a profile presenting a generally convex portion Pcx near the cutting point or cutting end 11 and a generally concave portion Pcv positioned further away from the cutting end 11. The convex portion Pcx shifts to the concave portion Pcv at an inflection point Pic. The body 10 may have a base portion 12, which may include a substantially cylindrical shoulder or portion 13.

The concave portion may be formed by a number of linear frusto-conical segments L10, L8, L6, having a respective envelope which, seen in section, has a linear or straight profile.

Between each pair of frusto-conical segments, there may be a transition portion in the form of curved frusto-conical segments L9, L7. These segments may have a radius R9, R7. Each radius R9, R7 may be determined such that it provides a smooth transition with the respective adjacent linear segments L10, L8, L6.

Each one of the linear frusto-conical segments L10, L8, L6 may present a respective angle relative to the center axis A of the body 10.

The angles α10, α8, α6 will be determined by the extent of the generally concave portion Pcv, more particularly by the difference between the outer and inner radii Ro, Ri, between which the portion Pcv extends and by the axial length of the portion Pcv. The first angle α10 will always be 45°.

In the illustrated example, the angles α8, α6 will be 20.7° and 10.2° respectively.

Figure 2:
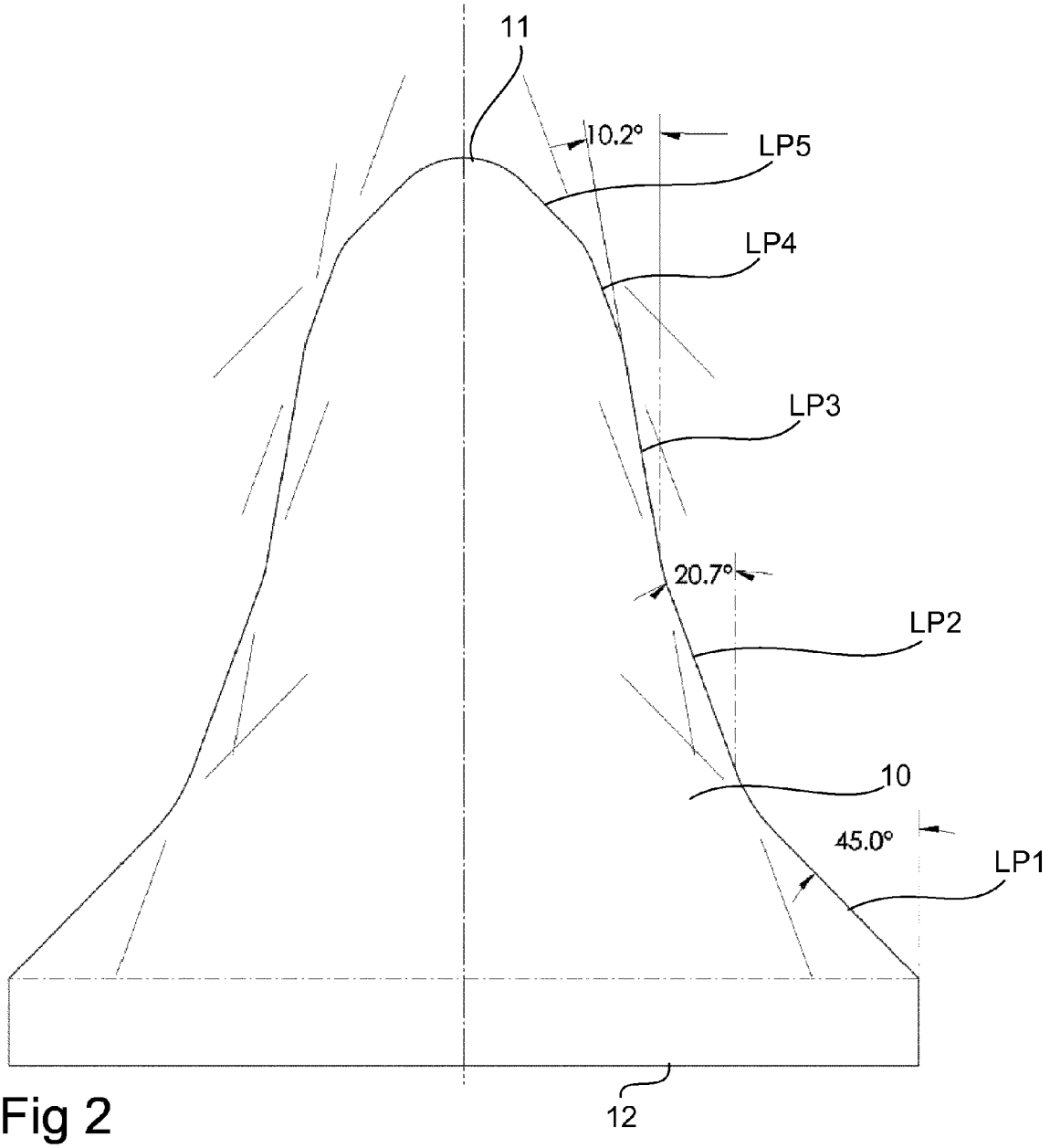
FIG. 2 is a schematic sectional view of the cutting tip according to the present disclosure.

In table 1 below, the lengths and angles of the concave portion Pcv illustrated in FIGS. 1 and 2 are set forth.

TABLE 1

| Measures of concave portion Pcv | | |
|---|---|---|
| Axial portion | Axial length (Lcv) [% of total length of portion] | Angle [relative to center axis] |
| L10 | 23.4% | 45° |
| L9 | 10.3% | |
| L8 | 29.0% | 20.7° |
| L7 | 4.7% | |
| L6 | 32.7% | 10.2° |

Figure 3A:
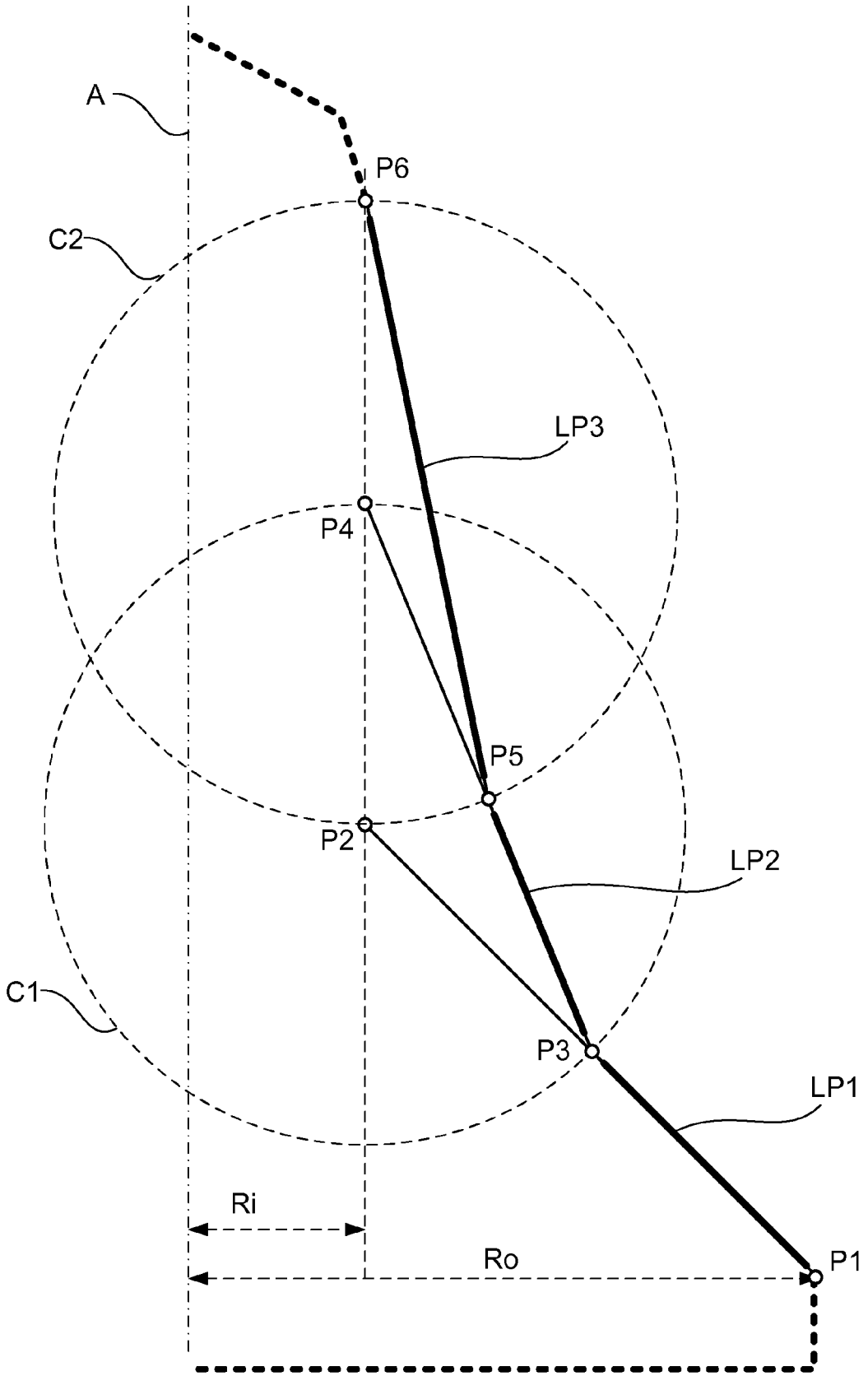
FIGS. 3*a* and 3*b* are schematic sectional diagrams illustrating the design principle applied in the present disclosure.

An example of an application of the design principle, as applied to a concave portion, will now be given with reference to FIG. 3*a*, where a generally conical and concave portion Pcv (FIG. 1) is to be provided between an outer radius Ro and an inner radius Ri.

The length of the portion (and of the cutting tip), as well as its outer radius Ro and the inner radius Ri may be selected at will. However, in practice, the selection will be based on the space available on/in the drive body, the strength requirements and on the attachment mechanism, for which sufficient space inside the cutting tip may need to be provided.

The description will be provided on a two-dimensional basis, keeping in mind that what is described is actually a rotationally symmetric shape, where the profile described is rotated about the center axis A.

A starting point P1 is selected on the outer radius Ro. The outer radius Ro may be situated on the outermost perimeter of the cutting tip. However, it is possible to provide another convex portion outside the outer radius Ro.

A first line is drawn from a first point P1 on the outer radius Ro towards the center axis A and the cutting end 11. The first line forms an angle of 40°-50°, preferably 45° relative to the center axis A.

At a second point P2, the first line intersects with the inner radius Ri. A first circle C1 is drawn having its centre at the second point P2 and a radius, which is approximately equal to half the length of the first line.

A third point P3 is selected as the middle point of the first line, i.e. where the circle intersects the first line.

A fourth point P4 is selected as a point on the inner radius between the second point and the axial position of the cutting end 11, where the first circle intersects the inner radius Ri. The fourth point P4 is thus at an axial distance from the second point P2 corresponding to half of the length of the first line. Hence, the third and fourth points P3, P4 are both on the perimeter of the first circle C1 having its centre in the second point P2.

A second line is drawn between the third and fourth points P3, P4. A second circle C2 is drawn having its centre at the fourth point P4 and a radius, which is approximately equal to half the length of the second line.

A fifth point P5 is selected as the middle point of the second line i.e. where the circle intersects the second line. A sixth point P6 is selected according to the same criterion as the fourth point was selected. Hence, the fifth and sixth points P5, P6 are both on the perimeter of a second circle C2 having its centre in the fourth point P4. A third line is drawn between the fifth and sixth points P5, P6.

The outer surface of the concave portion Pcv may now be defined as a portion of the first line extending approximately between the first and third points P1, P3, thus providing a first linear portion LP1, a portion of a second line extending approximately between the third and fifth points P3, P5, thus providing a second linear portion LP2 and a portion of the third line extending approximately between the fifth and sixth points P5, P6, thus providing a third linear portion LP3. By "approximately", it is understood that there may be radii R9, R7 forming transitions between the linear portions.

While the present example illustrates an embodiment wherein the concave portion presents three linear portions LP1, LP2, LP3, it is conceivable to include further linear portions, thus providing a total of four, five, six or seven linear portions, each of which being designed according to the iterative design method outlined above, with all but the first one and last one being designed according to the principle of the second linear portion LP2.

Hence, there is provided a cutting tip, presenting a generally conical body, which is substantially rotationally symmetric about a center axis of the cutting tip and presenting a profile in a longitudinal section through the center axis. The profile comprises a generally convex portion Pcx, which extends from a cutting end situated on the center axis A, to an inflection point Pic, which is located at an axial distance from the cutting end 11, towards a base portion of the body and at an inner radius, and a generally concave portion Pcv, which extends from the inflection point Pic to a point which is located at a greater, outer radius Ro and axially closer to the base portion 12.

The profile's concave portion may present a first linear portion LP1, defined by a portion of a first line, which first line extends inwardly from a first point P1 at the outer radius Ro, at an angle of about 45 degrees relative to the center axis C, to a second point P2 at the inner radius, and a second linear portion LP2, defined by a portion of a second line, which second line extends from a third point P3, forming an approximate middle point of the first line, to a fourth point P4 on the inner radius at an axial distance from the second point P2 towards the cutting end 11 corresponding to about half a length of the first line.

The generally concave portion Pcv may further comprise third linear portion LP3, defined by a portion of a third line, which third line extends from a fifth point P5, forming a middle point of the second line, to a sixth point P6 on the inner radius at an approximate axial distance from the fourth point P4 towards the cutting end 11 corresponding, to about half a length of the second line.

The same design principle may be applied to provide a generally conical convex portion Pcx at the cutting end 11 of the cutting tip 1, as will be described below.

The frusto-conical segment L2 closest to the cutting end may present an angle α2 which is 45° relative to the center axis A. In the illustrated example, the next frusto-conical segment L4 may present an angle α4, which is 20.7° relative to the center axis A.

Hence, the convex portion presents frusto-conical segments L2, L4, which present angles α2, α4 which are identical with angles α10, α8 of frusto-conical segments of the concave portion Pcv.

It is noted that the convex and concave portions may, apart from the approximately 45° portions, present portions having different angles.

In table 1 below, the lengths and angles of the convex portion Pcx illustrated in FIGS. 1 and 2 are set forth.

TABLE 2

Measures of convex portion Pcx

| Axial portion | Axial length (Lcx) [% of total length of portion] | Angle [relative to center axis] |
|---|---|---|
| L1 | 13.6% | |
| L2 | 36.4% | 45 |
| L3 | 15.6% | |
| L4 | 27.3% | 20.7 |
| L5 | 9.1% | |

At the transition (inflection point Pic) between the concave and convex portions Pcv, Pcx, there is also a curved frusto-conical segment L5 presenting a radius R5.

Figure 3B:
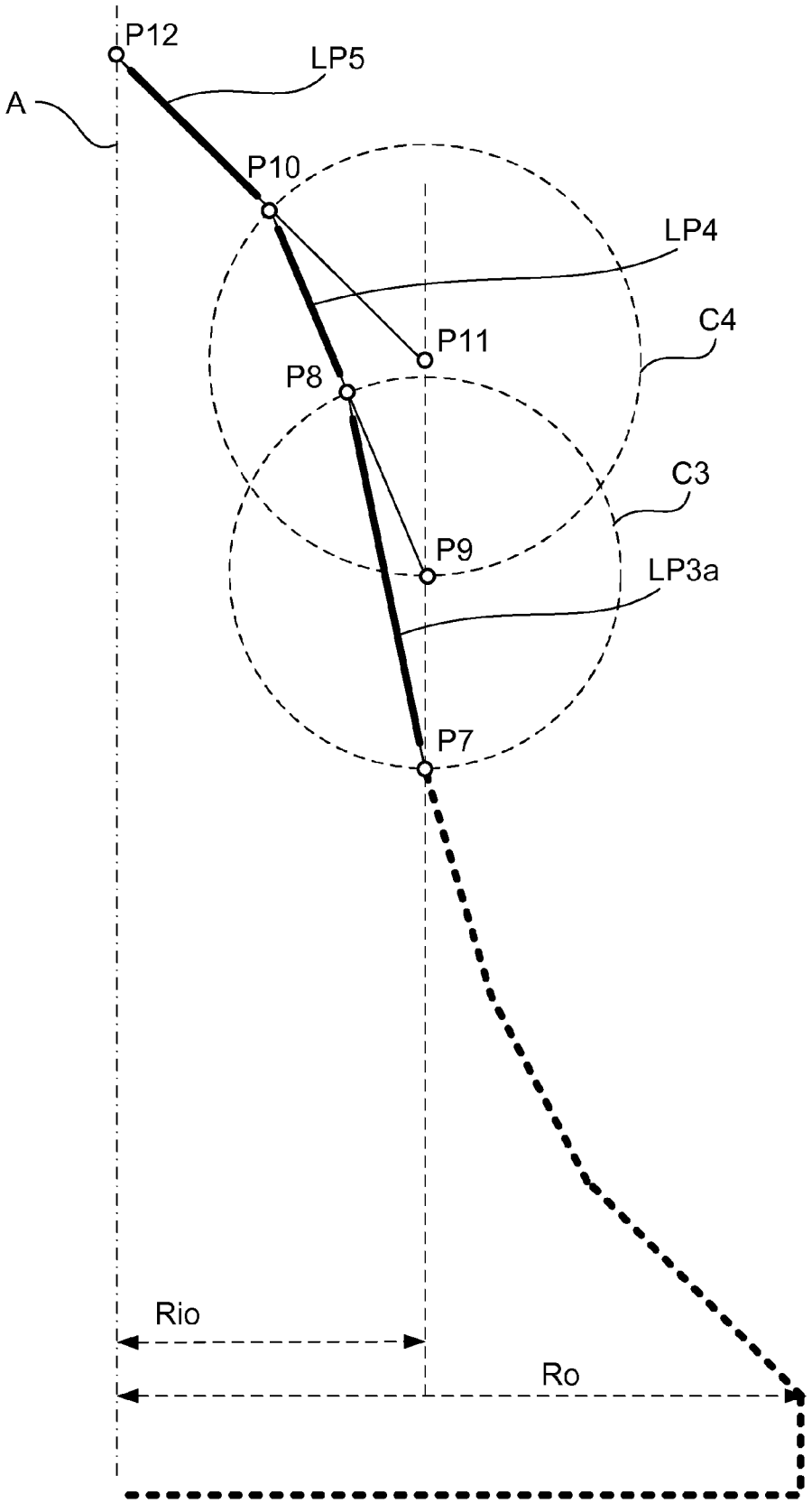

An example of an application of the design principle, as applied to a convex portion Pcx, will now be given with reference to FIG. 3*b*, where a generally conical and convex portion Pcx (FIG. 1) is to be provided between a second inner radius Rio and the center axis A of the cutting tip.

The second inner radius Rio may be identical with the inner radius Ri used for the concave portion Pcv. However, it is also possible to select the second inner radius Rio independently. In the example disclosed in FIGS. 1-2, it is noted that Ri<Rio<Ro.

The description will be provided on a two-dimensional basis, keeping in mind that what is described is actually a rotationally symmetric shape, where the profile described is rotated about the center axis A.

A starting point P12 is selected on the center axis A. A first line is drawn from the center axis A towards the second inner radius Rio. The first line forms an angle of 40°-50°, preferably 45° relative to the center axis A.

At a second point P11, the first line intersects with the second inner radius Rio. A third point P10 is selected as the middle point of the first line. A first circle C4 is drawn, having its centre at P11 and having a radius which equals half the length of the first line from P12 to P11.

A fourth point P9 is selected as a point on the second inner radius Rio where the first circle C4 intersects the second inner radius Rio.

A second line is drawn between the third and fourth points P10, P9.

A second circle C3 is drawn, having its centre at P9 and having a radius which equals half the length of the second line from P10 to P9. A fifth point P8 is selected as the middle point of the second line. A sixth point P7 is selected as a point on the second inner radius Rio where the second circle C3 intersects the second inner radius Rio.

A third line is drawn between the fifth and sixth points P8, P7.

The outer surface of the convex portion Pcx may now be defined as a portion of the first line extending between the first and third points P12, P10, thus providing a first linear portion LP5; a portion of a second line extending between the third and fifth points P10, P8, thus providing a second linear portion LP4 and a portion of the third line extending between the fifth and sixth points P8, P7, thus providing a third linear portion LP3*a*.

Hence, there is provided a cutting tip, presenting a generally conical body, which is substantially rotationally symmetric about a center axis of the cutting tip and presenting a profile in a longitudinal section through the center axis. The profile comprises a generally convex portion Pcx, which extends from a cutting end situated on the center axis A, to an inflection point Pic, which is located at an axial distance from the cutting end 11, towards a base portion of the body and at an inner radius, and a generally concave portion Pcv, which extends from the inflection point Pic to a point which is located at a greater, outer radius Ro and axially closer to the base portion 12.

The profile's generally convex portion (Pcx) comprises a first linear portion LP5, defined by a portion of a first line, which first line extends outwardly from a first point P12 the center axis A, at an angle of about 45 degrees relative to the center axis A, to a second point P11 at a second inner radius Rio, and a second linear portion LP4, defined by a portion of a second line, which second line extends from a third point P10, forming an approximate middle point of the first line, to a fourth point P9 on the second inner radius Rio at an axial distance from the second point P11 towards the base portion 12, corresponding to about half a length of the first line.

The generally convex portion Pcx may further comprises third linear portion LP3*a*, defined by a portion of a third line, which third line extends from a fifth point P8, forming an approximate middle point of the second line, to a sixth point P7 on the second inner radius Rio at an axial distance from the fourth point P9 towards the base portion 12 corresponding to about half a length of the second line.

It is noted that the linear portions LP5, LP4, LP3*a* may be separated by respective transitions in the form of radii R3 (FIG. 1).

It is possible to apply the tree design principle to only the convex portion, only the concave portion or to both portions of the cutting tip.

In the embodiment disclosed in FIGS. 1, 2, the tree design principle has been applied to the concave portion Pcv based on an outer radius and on an inner radius, respectively. Here, the tree design principle has also been applied to the convex portion Pcx based on the center axis and a different second inner radius, such that Ri<Rio<Ro. The angles (45 degrees and 20.7 degrees, respectively) of the segments closest to the cutting end 11 correspond to the angles of the two segments closest to the base portion 12.

Figure 4A:
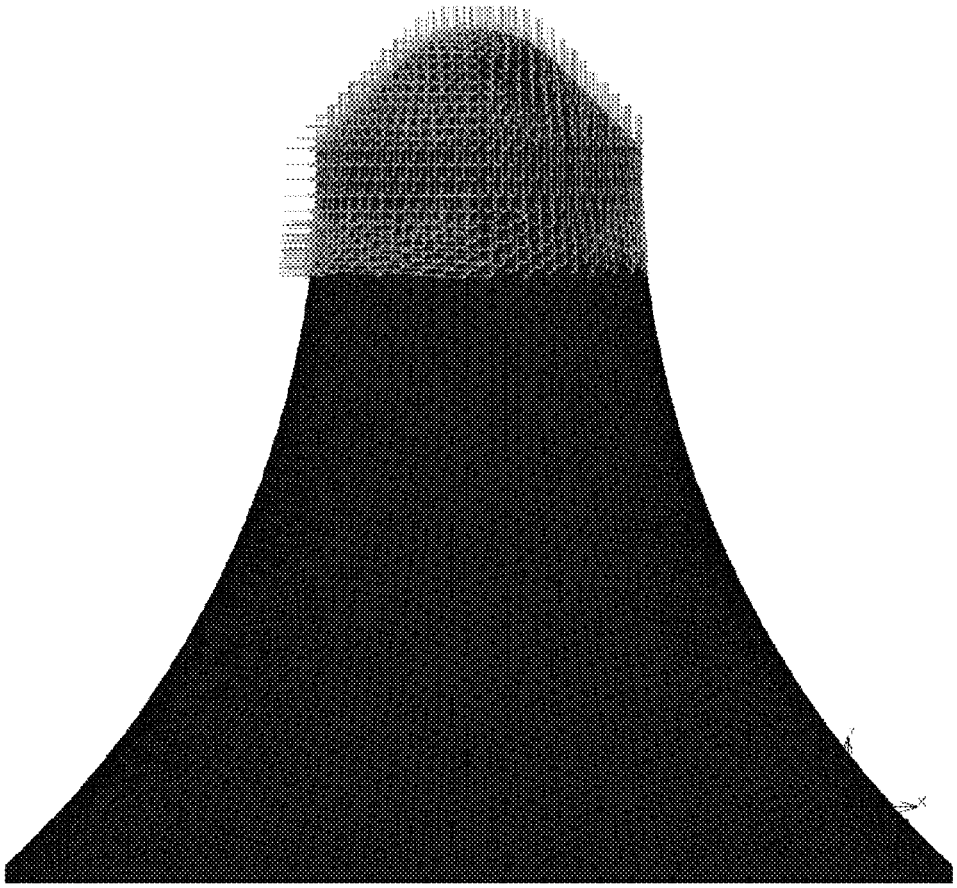
Fig 4a Prior Art
FIGS. 4*a* and 4*b* illustrate the force distribution in the following simulations.
Figure 4B:
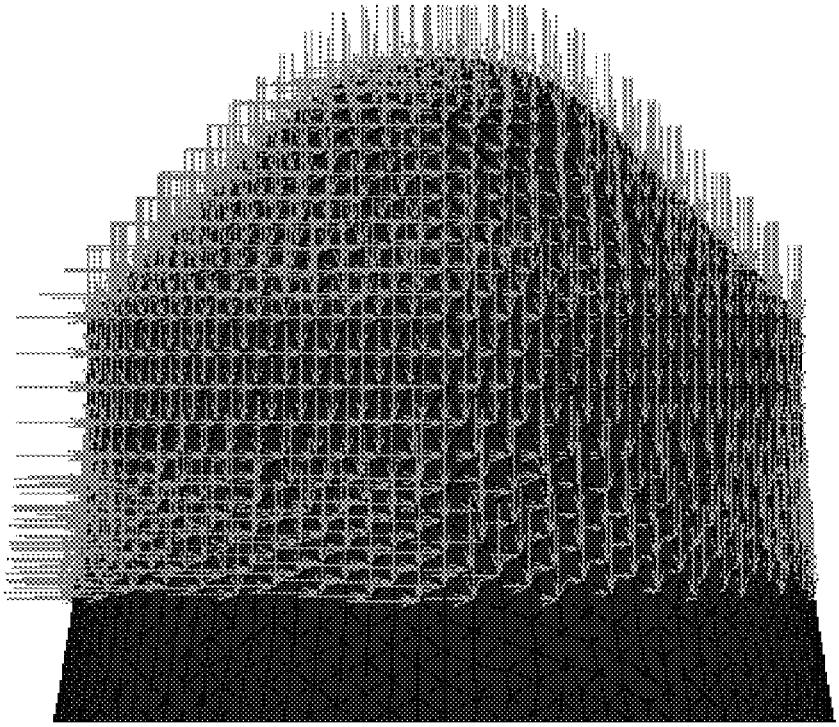
Fig 4b Prior Art

Referring to FIGS. 4*a* and 4*b*, an FEM based simulation comparing the cutting tip according to the present disclosure with a prior art cutting tip, which, technically is deemed to be a state of the art cutting tip.

The grey arrows in FIGS. 4*a* and 4*b* show forces applied to the cutting tip. FIG. 4*b* shows a magnified view of the top portion of the cutting tip of FIG. 4*a*. The simulation basically assumes that the cutting tip is subjected to evenly distributed forces downwardly and from left to right in FIGS. 4*a*-4*b*.

In all cases the load is distributed homogenously in a region covering the uppermost 68 mm2 of the cutting tip in all cases under study, according to FIG. 1. The bottom has a fixed displacement of (0,0,0), i.e. no movement.

In these cases the boundary condition (BC) in the bottom 12 is no longer of greatest importance, since the highest stresses are found higher up on the cutting tip 11, quite some distance from the bottom BC.

A more important parameter is how much of the cutting tip that is assumed to be in contact with the surroundings, since for a given load, the stress level becomes higher the smaller the contact area is assumed to be. But, if a comparison between the different geometries is all that is desired, then the comparison should be valid even if the absolute values of the stress can be somewhat off, compared to the real situation depending on how much the tool actually digs into the ground for a given load. So, If the absolute values of the stresses are important, than this factor would need a very thorough investigation, since the contact area will increase a lot if 5 mm is assumed to be in contact instead of 4 mm, and with that the stress levels will decrease quite a lot. But the comparison between the two cases is expected to end up in the same way, given that the load and assumed penetration is assumed to be the same in both cases.

Figure 5A:
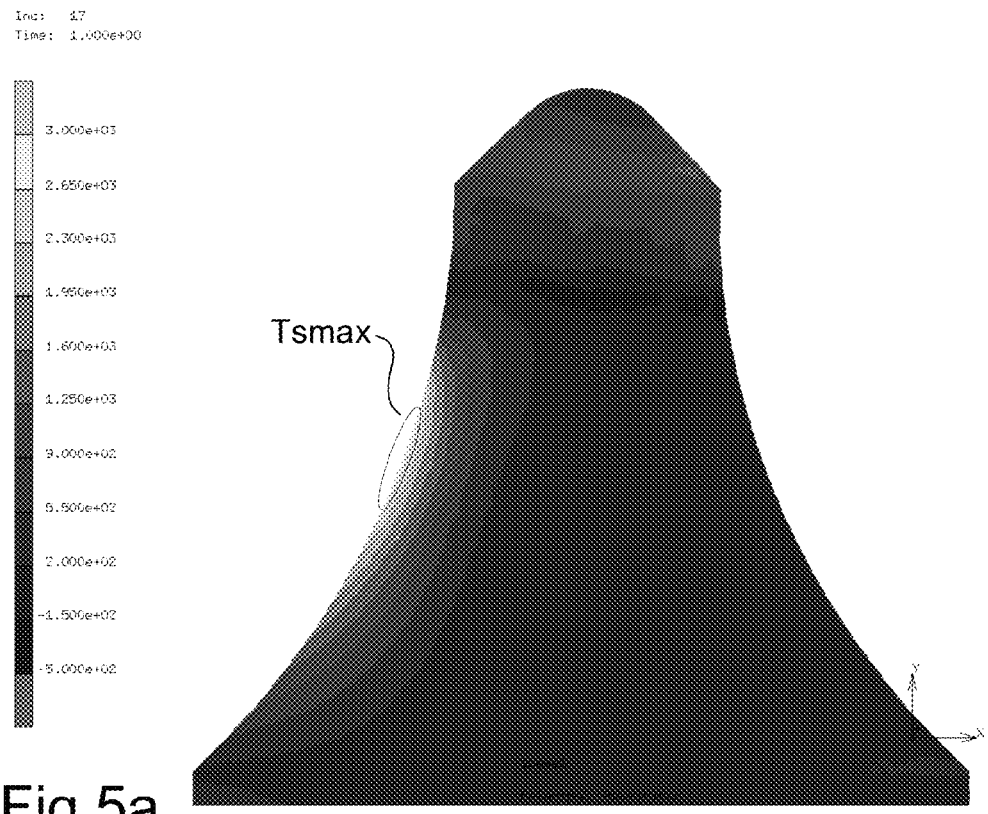
Fig 5a Prior Art
FIGS. 5*a* and 5*b* illustrate the simulation results of a standard (prior art) cutting tip.
Figure 5B:
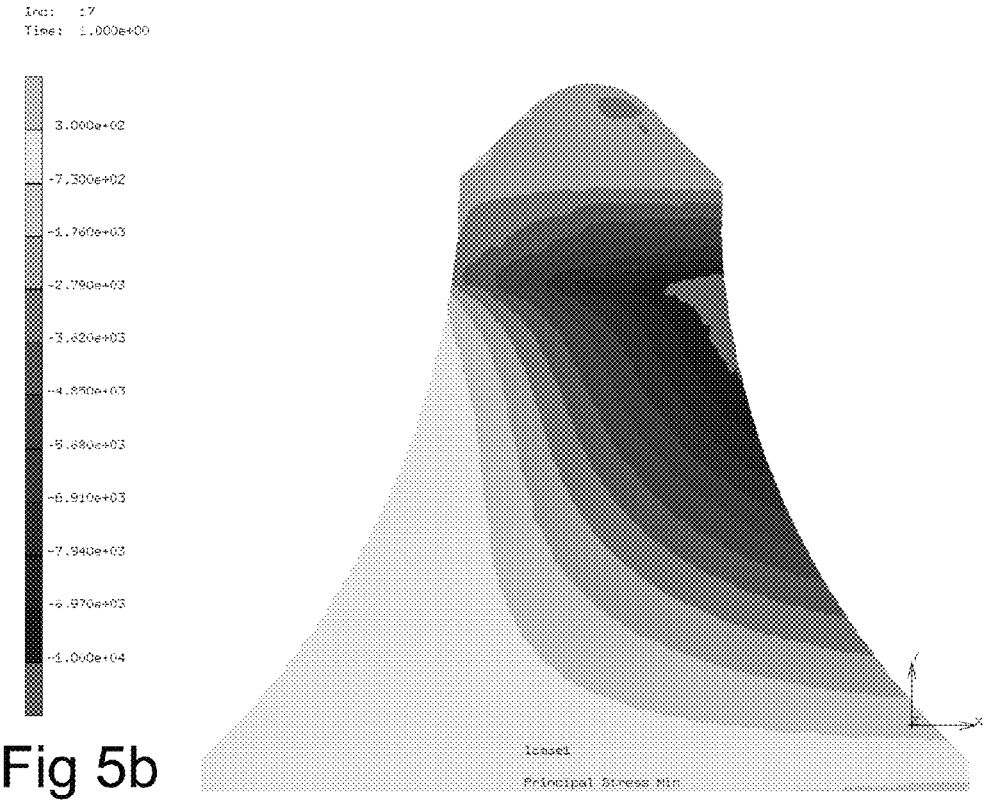
Fig 5b Prior Art

In the FIGS. 5*a*-5*b*; 6a-6b, the principal stresses (min and max) are shown. From experience, it is known that this metal can withstand high compressive stresses but not such high tensile stresses, the minimum principal stresses (compressive stresses, FIGS. 5*b*, 6*b*) could be rather high, but high values on the maximum principal stresses (tensile stresses, FIGS. 5*a*, 6*a*) should not become too high.

Figure 6A:
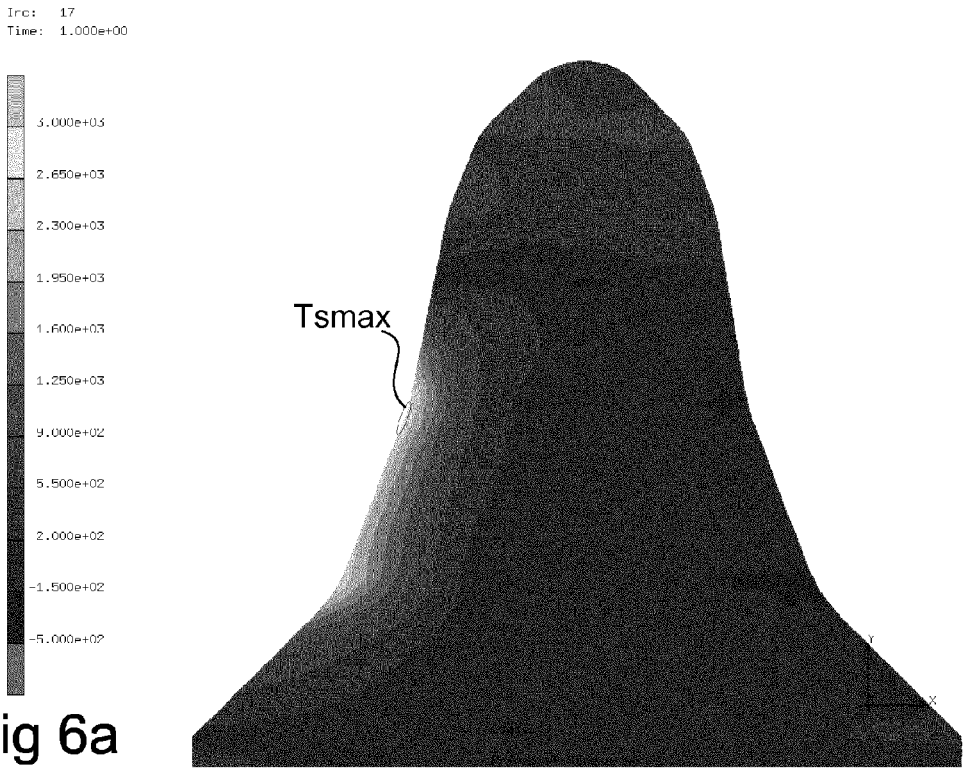
FIGS. 6*a* and 6*b* illustrate the simulation results of a cutting tip according to the present disclosure.
Figure 6B:
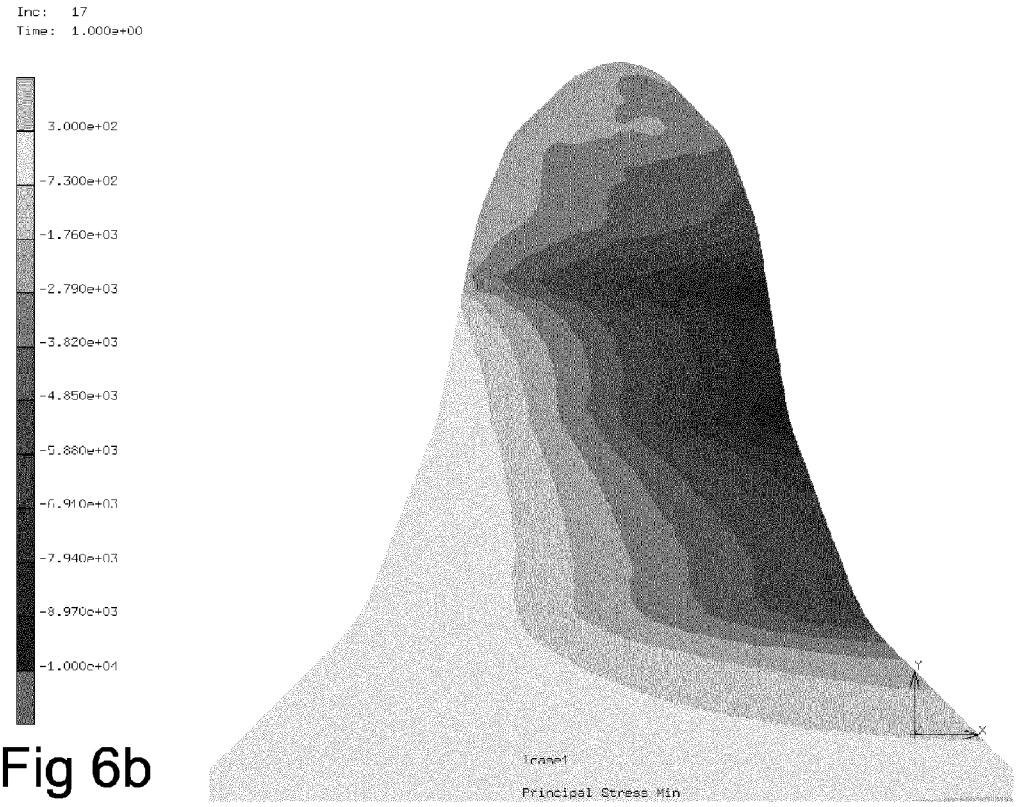

Comparing FIGS. 5*a* and 5*b*, it is noted that in FIG. 5*a*, the area showing the maximum tensile stress, indicated as Tsmax, is considerably larger than the corresponding area of FIG. 6*a*. This indicates that the maximum tensile stress level in the cutting tip according to the present disclosure is achieved at a much smaller portion of the cutting tip than what would be the case with the prior art cutting tip.

In view of the fact that the cutting tip according to the present disclosure, due to the shape of its cutting end, provides improved penetration, this indicates that an improvement has been achieved.

The cutting tips according to the present disclosure may be provided as a one piece cutting tip, with all, or parts thereof, in particular in the area of the cutting end 11, being provided with a coating, such as diamond, polycrystalline diamond compact or any other hard surface coating.

A releasable attachment mechanism may be provided in a non-shown cavity in the cutting tip. Such a cavity may extend axially from the base 12 of the cutting tip towards the cutting end 11.

Figure 7:
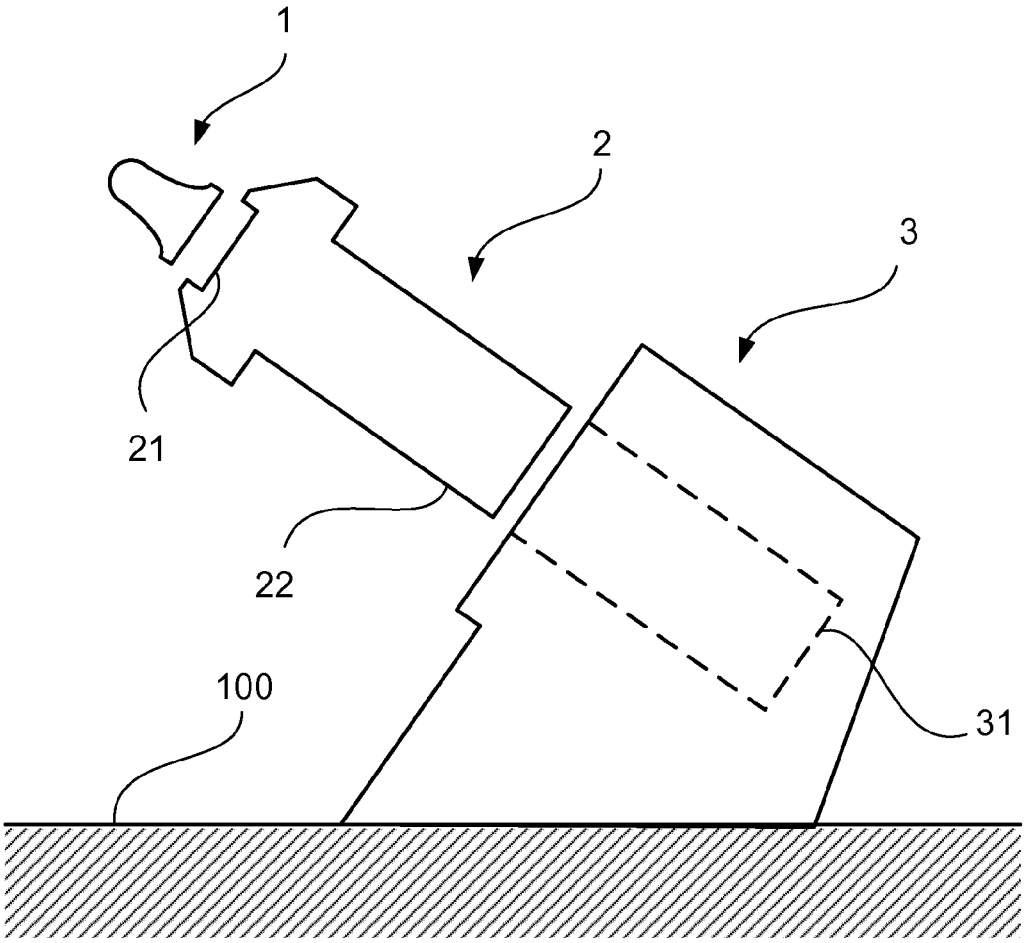
FIG. 7 schematically illustrates a tool assembly.

FIG. 7 schematically illustrates a tool assembly, which is mounted on a drive body 100. The assembly may comprise a block 3 having a bore 31 for releasably receiving a shank 22 of a tool pick 2. A cutting tip 1 as disclosed above may be attached, e.g. by brazing, in a receptacle or a front surface 21 which may be provided at a head portion of the tool pick 2. The tool pick 2 and the cutting tip 1 together form a cutting bit.

The disclosures in EP Patent Application No. 11171611.4, from which this application claims priority, are incorporated herein by reference.

The invention claimed is:

1. A cutting tip having a conical body substantially rotationally symmetric about a center axis and having a profile in a longitudinal section through the center axis, the profile comprising:

a convex portion extending from a cutting end situated on the center axis, to an inflection point located at an axial and radial distance from the cutting end, towards a base portion of the body;

a concave portion extending from the inflection point to a point located at a greater radial and axial distance from the cutting end and axially closer to the base portion, at least one of the concave portion and the generally convex portion including a first linear portion, defined by a portion of a first line, the first line extending from a first point at a first radial position at an angle of about 45 degrees relative to the center axis, to a second point at a second radial position and axially spaced from the first point, and a second linear portion defined by a portion of a second line, the second line extending from a third point, forming an approximate middle point of the first line, to a fourth point at the second radial position and at an axial distance from the second point corresponding to about half a length of the first line; and a transition portion disposed between each two adjacent linear portions, each transition portion having a radius that provides a smooth transition between the adjacent linear portions.

2. The cutting tip as claimed in claim 1, wherein at least one of the concave portion and the convex portion includes a third linear portion defined by a portion of a third line, the third line extending from a fifth point, forming an approximate middle point of the second line, to a sixth point at the second radial position and at an axial distance from the fourth point corresponding to about half a length of the second line.

3. The cutting tip as claimed in claim 1, wherein the convex portion includes at least two linear sections presenting a respective angle relative to the center axis, the concave portion having at least two linear sections presenting a respective angle relative to the center axis, the angles of all successive linear sections of the convex portion increasing towards the cutting end, and the angles of all successive linear sections of the concave portion decreasing towards the cutting end.

4. The cutting tip as claimed in 3, wherein all angles of the linear sections of at least one of the convex portion and the concave portion are greater than about 5 degrees.

5. The cutting tip as claimed in claim 1, wherein in the concave portion, the first radial position is at an outer radius and the second radial position is at an inner radius, which is smaller than the outer radius.

6. The cutting tip as claimed in claim 5, wherein the inner radius is about 20-30% of the larger outer radius.

7. The cutting tip as claimed in claim 1, wherein in the convex portion, the first radial position is substantially at the center axis and the second radial position is at a greater inner radius.

8. The cutting tip as claimed in claim 7, wherein two linear sections forming part of the convex portion present substantially the same angles as respective linear sections forming part of the concave portion.

9. The cutting tip as claimed in claim 1, wherein a linear section forming part of the convex portion presents substantially the same angle as a linear section forming part of the concave portion.

10. The cutting tip as claimed in claim 1, further comprising a radius forming the cutting end.

11. The cutting tip as claimed in claim 10, wherein the concave portion has a third linear portion presenting an angle of about 10 degrees.

12. The cutting tip as claimed in claim 1, wherein the concave portion has two linear portions, presenting, as seen axially from the base portion towards the cutting end, angles of about 45 degrees and about 21 degrees, respectively.

13. The cutting tip as claimed in claim 1, wherein the concave portion includes three linear portions having axial lengths of about 23%, about 29% and about 33%, respectively, of an overall length of the concave portion.

14. The cutting tip as claimed in claim 1, wherein the convex portion includes two linear portions, having as seen axially from the base portion towards the cutting end, angles of about 21 degrees and about 45 degrees, respectively.

15. The cutting tip as claimed in claim 1, wherein the convex portion has two linear portions having axial lengths of about 40% and about 30%, respectively, of an overall length of the convex portion.

16. A cutting bit having a tool pick with a head portion and a shank, said head having a front surface, a side surface extending axially rearwardly from the front surface toward a shoulder, the cutting bit comprising a cutting tip mounted to the front surface of the head, the cutting tip including a conical body substantially rotationally symmetric about a center axis and having a profile in a longitudinal section through the center axis, the profile including a convex portion extending from a cutting end situated on the center axis, to an inflection point located at an axial and radial distance from the cutting end, towards a base portion of the body; and a concave portion extending from the inflection point to a point located at a greater radial and axial distance from the cutting end and axially closer to the base portion, wherein the profile of at least one of the concave portion and the convex portion includes a first linear portion defined by a portion of a first line, the first line extending from a first point at a first radial position, at an angle of about 45 degrees relative to the center axis, to a second point at a second radial position and axially spaced from the first point and a second linear portion defined by a portion of a second line, the second line extending from a third point forming an approximate middle point of the first line, to a fourth point at the second radial position and at an axial distance from the second point corresponding to about half a length of the first line, and a transition portion disposed between each two adjacent linear portions, each transition portion having a radius that provides a smooth transition between the adjacent linear portions.

17. The cutting tip as claimed in claim 1, wherein each transition portion is a curved frusto-conical segment.

* * * * *